US005154556A

United States Patent [19]

Wappel

[11] Patent Number: 5,154,556

[45] Date of Patent: Oct. 13, 1992

[54] RETENTION DEVICE FOR METAL CYLINDRICAL CONTAINERS

[75] Inventor: Thomas E. Wappel, Lansing, Ill.

[73] Assignee: Camco International Inc., Houston, Tex.

[21] Appl. No.: 575,078

[22] Filed: Aug. 30, 1990

[51] Int. Cl.[5] ..... F17C 13/08

[52] U.S. Cl. ..... 410/36; 410/42; 410/47; 410/78; 410/94; 410/97; 211/71

[58] Field of Search ..... 410/32, 34, 35, 36, 410/38, 42, 47, 50, 68, 78, 80, 94, 85, 97, 103; 108/51.1, 55.1, 53.3; 296/37.1, 37.6; 211/71, 181; 206/386, 499, 503, 585, 591

[56] References Cited

U.S. PATENT DOCUMENTS

| | | | |
|---|---|---|---|
| Re. 22,507 | 6/1944 | Heigis | 410/155 X |
| 1,772,902 | 8/1930 | Knowlton et al. | 410/50 X |
| 1,854,711 | 4/1932 | Mayer | 410/42 X |
| 2,412,873 | 12/1946 | Cosley | 211/74 |
| 3,040,767 | 6/1962 | Quenard | 211/71 X |
| 3,312,181 | 4/1967 | Davidson | 410/97 |
| 3,407,753 | 10/1968 | Stafford | 410/99 |
| 3,602,368 | 8/1971 | Gould | 211/71 X |
| 3,677,562 | 7/1972 | Bronstein | 410/97 |
| 3,863,799 | 2/1975 | Thomaswick et al. | 410/97 X |
| 3,993,344 | 11/1976 | Bennett | 410/36 |
| 4,061,391 | 12/1977 | Violette | 410/36 X |
| 4,175,666 | 11/1979 | Smith | 211/71 |
| 4,264,251 | 4/1981 | Blatt | 410/100 |
| 4,324,190 | 4/1982 | Hewitt | 410/42 X |
| 4,358,232 | 11/1982 | Griffith | 410/100 |
| 4,529,345 | 7/1985 | Van Gompel | 410/42 |
| 4,576,531 | 3/1986 | Cosnet | 410/36 |
| 4,799,840 | 1/1989 | Van Gompel et al. | 410/42 |
| 4,846,610 | 7/1989 | Schoenleben | 410/34 X |
| 4,887,946 | 12/1989 | Sevier | 410/99 X |
| 4,899,895 | 2/1990 | Espasandin | 211/71 |

FOREIGN PATENT DOCUMENTS

| | | | |
|---|---|---|---|
| 203303 | 12/1986 | European Pat. Off. | 410/94 |
| 2007348 | 5/1979 | United Kingdom | 211/71 |

*Primary Examiner*—Michael S. Huppert
*Assistant Examiner*—William M. Hienz
*Attorney, Agent, or Firm*—Fulbright & Jaworski

[57] ABSTRACT

A retention device for retaining cylindrical containers in upright condition for transport, such as in a truck trailer. The retention device includes a plurality of vertically oriented container retention posts supported by upper and lower support rails. The retention posts are laterally spaced relative to each other such that a plurality of containers may be positioned in predetermined side-by-side relation with each container being disposed against a respective pair of retention posts and with additional containers being stacked outwardly thereof. Adjustably engageable straps are provided for releasable engagement with selected of the retention posts for encompassing the positioned containers within the rack and for retaining the containers firmly against the support posts and against each other.

21 Claims, 4 Drawing Sheets

RETENTION DEVICE FOR METAL CYLINDRICAL CONTAINERS

FIELD OF THE INVENTION

The present invention relates generally to devices for retaining heavy cylindrical tanks or like containers in upright condition, such as metal tanks used for storing pressurized oxygen, helium, or like gases, and more particularly, to devices for reliably and safely retaining such containers for transport.

BACKGROUND OF THE INVENTION

Oxygen, helium, and other gases commonly are supplied to the user in relatively heavy cylindrical tank-like containers of various sizes. The tanks typically are transported to the user in a truck trailer, and empty tanks are similarly returned to the supplier for refill. Such free standing gas containers can easily topple during handling and transport, which can not only damage the containers and surroundings, but also create a risk of explosion. To retain the cylindrical containers in upright condition during transport, it has been proposed to secure the containers to the walls of the truck trailer, such as by means of retaining straps or brackets. Since the containers when filled each may weigh as much as 150 pounds and the truck trailer walls usually are not reinforced, forces acting on the heavy containers during transport can cause the straps or retaining brackets to be torn out of the wall. As a result, it has not been possible to transport large numbers of such containers at the same time. Present container retention devices furthermore do not facilitate retention of large numbers of empty containers for return to the supplier for refilling. Prior retention devices also often have been complicated and have impeded handling of the containers during mounting in and removal from the retention device.

OBJECTS AND SUMMARY OF THE INVENTION

It is an object of the present invention to provide a retention device adapted for more reliably and safely retaining heavy gas cylinder containers in upright condition during transport.

Another object is to provide a gas cylinder container retention device as characterized above which is relatively simple in construction and which facilitates easy handling of the containers during loading and unloading.

A further object is to provide a gas cylinder container retention device of the above kind which can accommodate a single cylinder, or a plurality of cylinders, in a free standing mode for safe transport and for easy access.

Still another object is to provide a gas cylinder container retention device which is of modular construction and which lends itself to easy installation and removal within a truck trailer for the purpose of accommodating different sized containers. A related object is to provide a modular system of such retention devices for facilitating transport of greater numbers of pressurized gas tanks both during transport and during return to the supplier for refill.

Other objects and advantages of the invention will become apparent upon reading the following detailed description and upon reference to the drawings, in which:

Figure 1:
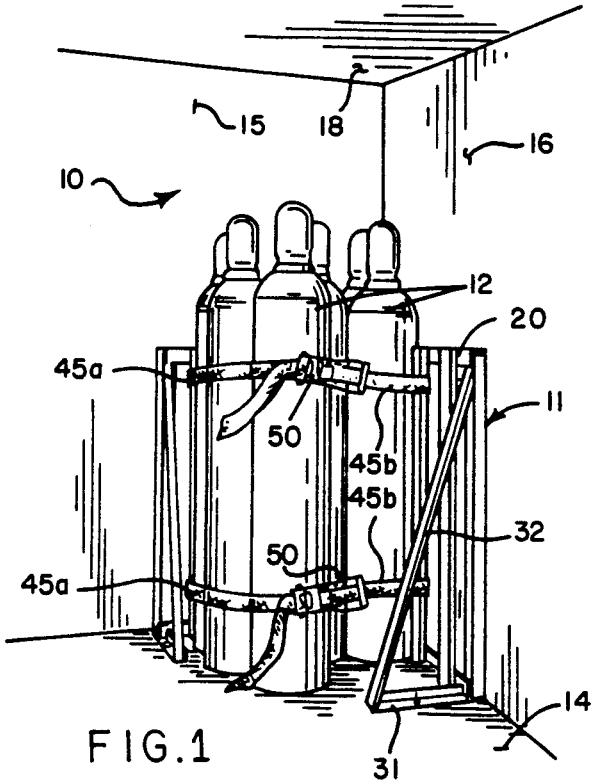
FIG. 1 is a perspective of the interior of a truck trailer having a gas cylinder retention device in accordance with the present invention.
Figure 3:
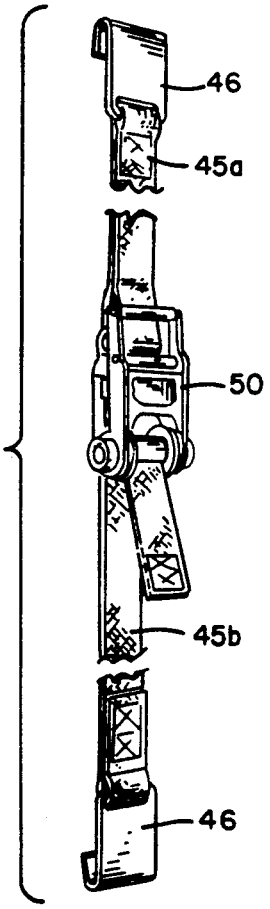
FIG. 3 is an enlarged perspective of one of the cylinder retention straps utilized in the illustrated device.
Figure 2:
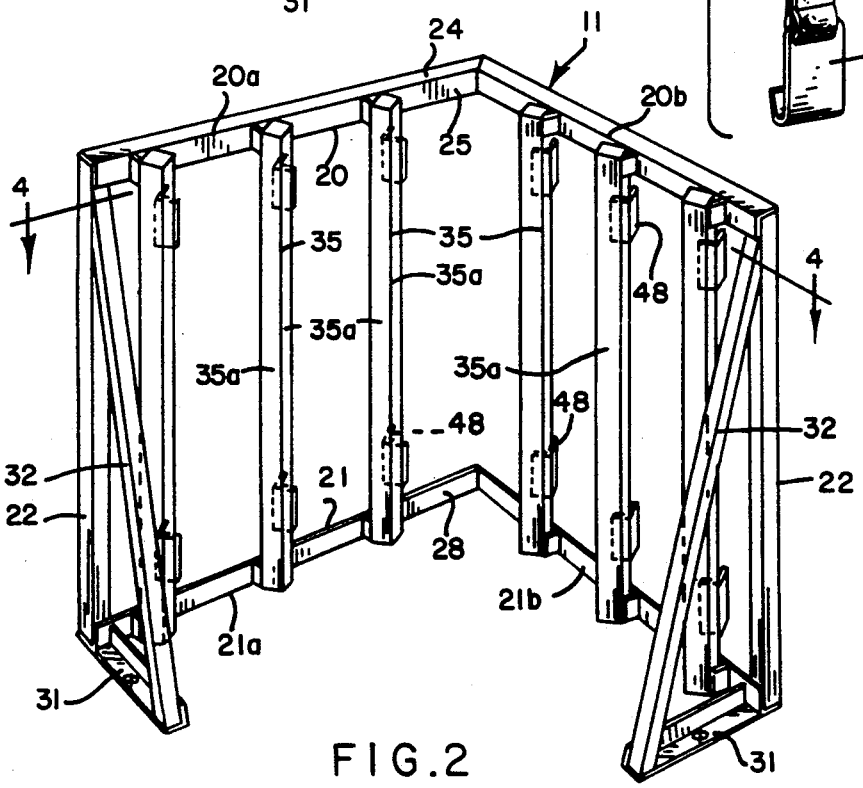
FIG. 2 is an enlarged perspective of the gas cylinder retention device shown in FIG. 1.

While the invention is susceptible of various modifications and alternative constructions, a certain illustrated embodiments thereof has been shown in the drawings and will be described below in detail. It should be understood, however, that there is no intention to limit the invention to the specific form disclosed, but on the contrary, the intention is to cover all modifications, alternative constructions and equivalents falling within the spirit and scope of the invention.

DESCRIPTION OF THE PREFERRED EMBODIMENTS

Figure 6:
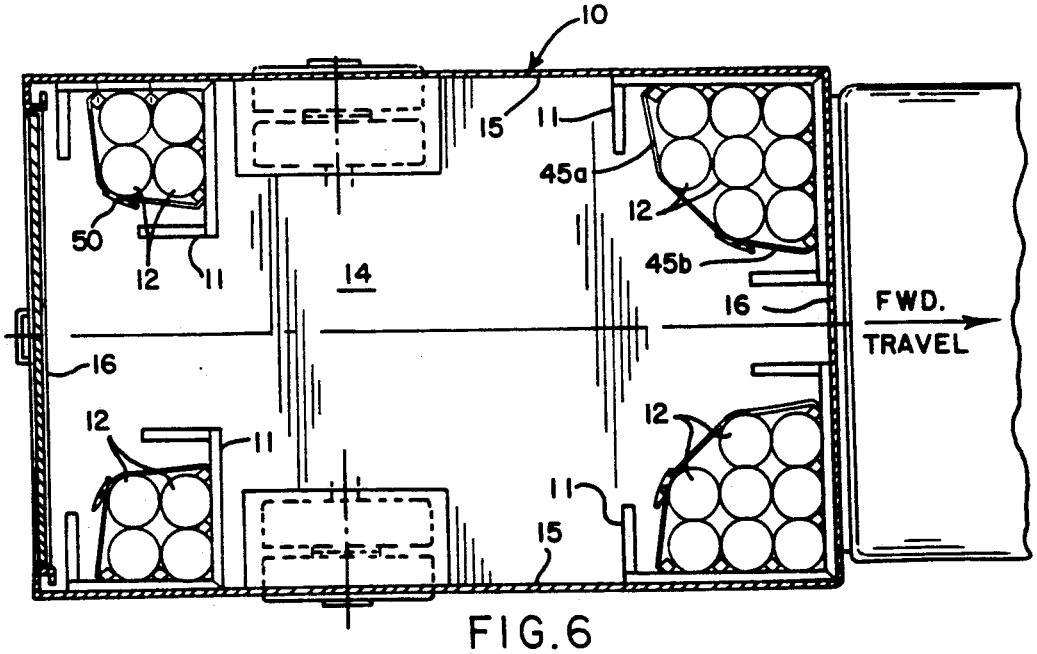
FIG. 6 is a horizontal section of a truck trailer showing a typical modular arrangement of the gas cylinder retention devices.

Referring now more particularly to the drawings, there is shown an illustrative truck trailer 10 having mounted therein a plurality of retention devices or racks 11 each adapted for securely retaining one or more metallic pressurized gas cylinders or tanks 12. The truck trailer 10, as best shown in FIGS. 1 and 6, has a rectangular flat bed 14, side and end walls 15, 16 and a ceiling 18 which define an interior cargo containing area. To facilitate weight distribution, the retention racks 11 in this instance are disposed in respective corners within the trailer. Since each of the retaining devices 11 is substantially similar in construction, only one need to be described in detail.

The illustrated racks 11 each comprise a pair of horizontal, vertically-spaced, support rails 20, 21 that are supported at opposite ends by upstanding frame members 22. The support rails 20, 21 each are formed by a pair of angle irons 20*a*, 20*b* and 21*a*, 21*b*, joined together in an L-shaped configuration for positioning into a respective corner of the trailer, as shown in FIG. 1. The angle irons 20*a*, 20*b* that define the upper support rail 20 each have a rearwardly extending horizontal flange 24 disposed adjacent the top of the rack and a depending flange 25. The angle irons 21*a*, 21*b* that define the lower support rail 21 each have a rearwardly extending horizontal flange 26 positionable on the flat bed 14 of the trailer and an upwardly extending flange 28. The upstanding frame members 22, which in this case each have a square tubular cross section, are disposed between the horizontal flanges 24, 26 of the upper and lower support rails 20, 21 immediately against rear sides of the vertical flanges 25, 28 and are rigidly secured thereto by appropriate weldments.

For securing the rack 11 within the truck trailer 10, the horizontal flanges 26 of the bottom support rail 21 are formed with mounting apertures 30 that permit the rack to be bolted or otherwise secured to the flat bed 14 of the trailer. To provide added stability for the rack 11, opposite ends thereof in this case are provided with forwardly extending legs 31 that are welded to the bottom support rail 21 in outwardly extending relation thereto and a crossbrace 32 is welded between the outer end of each leg 21 and the upper end of the end of the respective frame member 22. The forward legs 31 again preferably are in the form of angle irons that are formed with mounting apertures 30 to facilitate bolting thereof to the flat bed.

Figure 4:
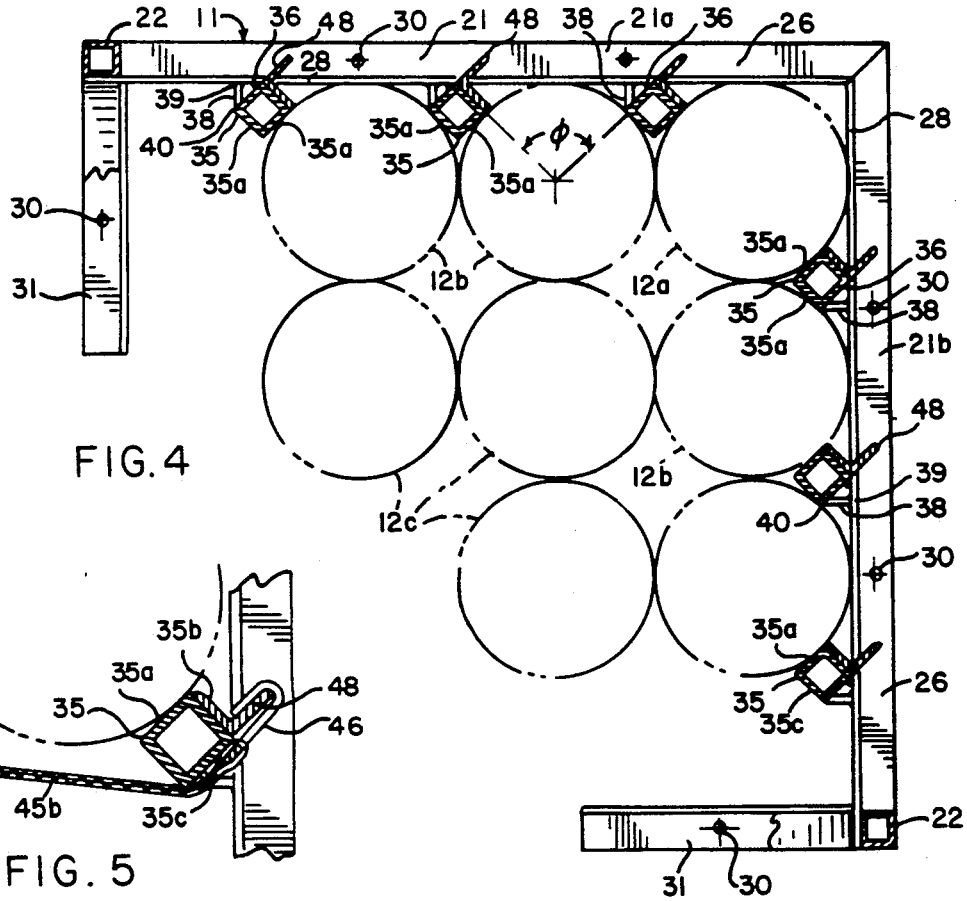
FIG. 4 is an enlarged horizontal section of the illustrated device, taken in the plane of line 4—4 in FIG. 2.

In accordance with the invention, the retention device includes a plurality of vertical cylinder supporting posts that have a spacing corresponding the diameter of the cylinders to be retained by the device so that the cylinders may be firmly positioned and located between adjacent posts and releasably secured thereto for safe transport. In the illustrated embodiment, as best shown in FIG. 4, the retention rack or device 11 includes a plurality of vertical cylinder retention posts 35 which each are in the form of square or rectangular tubing affixed between the support rails 20, 21 with outer sides 35*a* thereof disposed at angles of 45° to the support rails for defining angled bearing surfaces against which the curved sides of the cylinders 12 may be positioned and retained. For securing the retention posts 35 to the support rails 20, 21 in such manner, a rear corner of each retention post 35 is secured at opposite ends to the vertical flanges 25, 28 of the upper and lower support rails by weldments 36 and mounting plates 38 are secured between side corners of each post 35 and the respective upper and lower support rails by weldments 39, 40. It will be appreciated that securement of the retention posts 35 between the upper and lower support rails 20, 21 in such manner further rigidifies the rack.

As illustrated in FIG. 4, a plurality of gas cylinders 12 may be positioned into the rack 11 starting with a first container, designated 12*a*, positioned into the corner of the rack, with diametrically opposed sides of the container 12*a* being supported by outwardly exposed sides 35*a* of the retention posts 35 located closest to the corner of the rack. Additional containers, designated 12*b*, may be located between successive pairs of retention posts 35 outwardly of the corner of the rack, in this instance being supported between adjacent pairs of retention posts 35 at circumferential points spaced at an angle $\phi$ of about 95°, and still additional containers, designated 12*c*, may be positioned between the curved sides of the cylinders 12*a*, 12*b* in a precisely defined array.

Figure 5:
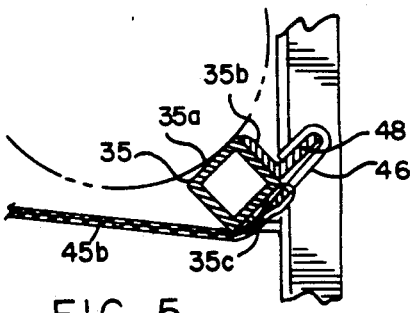
FIG. 5 is an enlarged fragmentary section showing engagement of a retention strap with a selected one of the support posts of the illustrated device.

In keeping with the invention, selectively adjustable and releasable strap means are provided for retaining various numbers of the cylindrical containers within the rack. To this end, in the illustrated embodiment, pairs of retaining straps 45*a*, 45*b* are provided that may be removably secured between selected pairs of the retention posts 35 on opposite sides of the array of containers 12 to be retained for maintaining the containers in firm engagement with each other and against the retention posts 35. Each strap 45*a*, 45*b* has a hook 46 at its outer end for releasable securement to a respective mounting flange 48 secured to the retention post 35. The mounting flanges 48 in this case are affixed adjacent top and bottom ends of each retention post 35. The illustrated mounting flanges 48 are formed by angle irons, each having one leg secured to a rear face 35*b* of the post (FIG. 5) such that the other leg, which defines the mounting flange 48, extends rearwardly in the plane of the other rear face 45*c* of the post and parallel to a plane that bisects the angle defined by the support rails 20, 21. The opposite ends of each pair of straps 45*a*, 45*b* are provided with a selectively engageable rachet type buckle arrangement 50 of a conventional type that permits the straps 45*a*, 45*b* to be adjustably secured and locked in any drawn position about the array of cylinders within the rack for securing the containers firmly against the rack and against each other.

Figure 7:
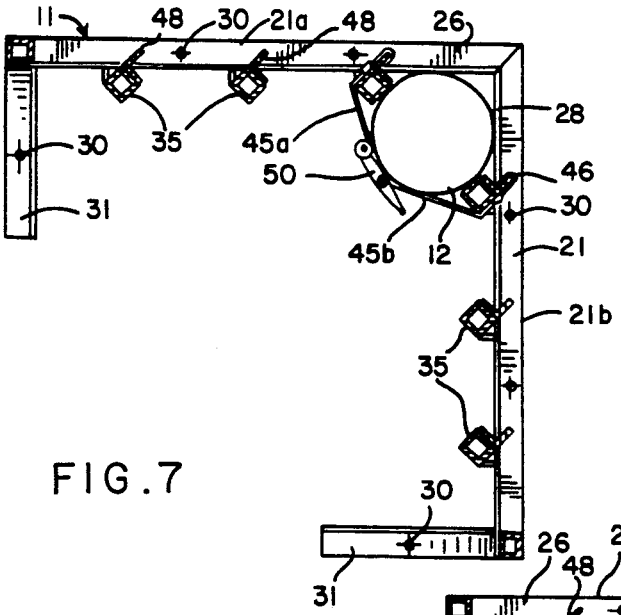
FIG. 7 is a horizontal section illustrating the mounting of a single gas cylinder in one of the retention devices.
Figure 8:
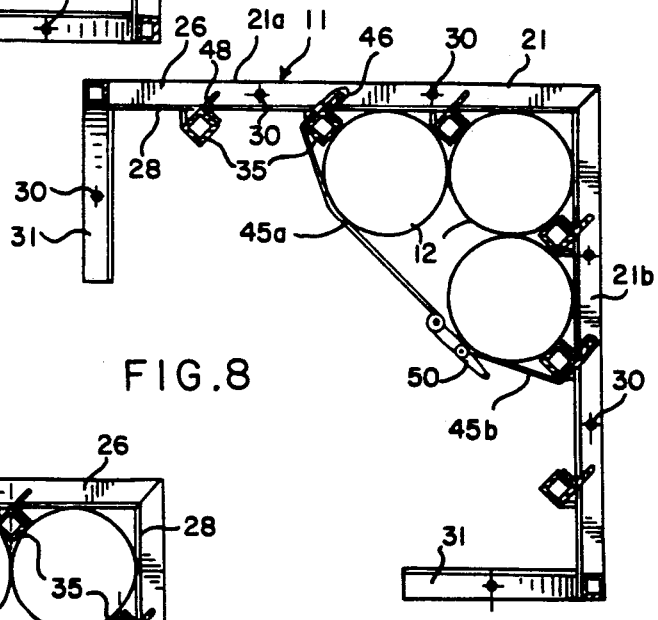
FIG. 8 is a horizontal section, similar to FIG. 7, but showing the retention of three gas cylinders within the device.
Figure 9:
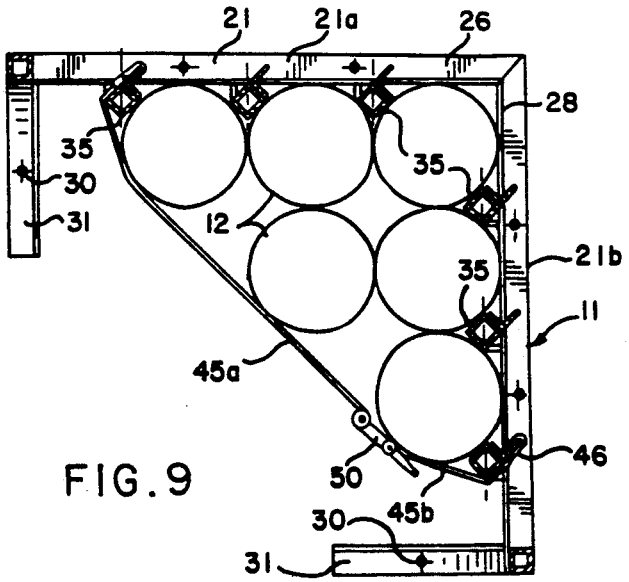
FIG. 9 is a horizontal section, similar to FIGS. and 8, showing six cylinders secured within the retention device.

As shown in FIG. 7, the retention straps 45*a*, 45*b* may be secured to the mounting flanges 48 of the posts 35 immediately next to the corner of the rack for securing a single cylinder 12 in the corner of the rack. As shown in FIG. 8, three cylinders 12 may be retained by securing the hooks 46 of the straps 45*a*, 45*b* about the flanges 48 of the second posts 35 outwardly from the corner of the rack, and as shown in FIG. 9, six cylinders 12 are shown retained within the rack by securing the straps 45*a*, 45*b* to the mounting flanges 48 of the third posts 35 outwardly from the corner of the rack. It will be appreciated by one skilled in the art that the number of filled gas containers that might be secured within the rack for transport to a users site may be limited by weight limitations. Nevertheless, the racks preferably are of sufficient size to accommodate larger numbers of empty containers during their return transport for refill.

Because of the individualized or modular nature of the racks 11, it will be appreciated, as illustrated in FIG. 6, that the racks may be selectively mounted within the truck trailer 10 to achieve the desired weight distribution or space utilization. As illustrated, the racks 11 may be positioned into respective corners of the truck trailer with the support rails 20, 21 thereof adjacent side and end walls of the trailer as shown in the forward end of the illustrated truck trailer, and alternatively, as depicted in the rear of the illustrated trailer, the racks 11 may be positioned with one side thereof adjacent a side wall of the trailer and the other side extending into the trailer. The mounting apertures 30 in the bottom support rails 21 permit convenient bolting of the rack to the flat bed 64 of the trailer, and the upper support rails 20 also may be secured to the side and end walls of the trailer, if desired. The general rectangular configuration of the rack defined by the L-shaped support rails 20, 21 and the forwardly extending legs 31 enhances stable mounting.

It will further be appreciated that the modular design of the racks 11 enables installation of selective racks in the trailer for the particular size cylindrical containers to be transported. Since the sides 35*a* of the retention posts 35 between which the containers 12 are retained form an angle of about 90° to each other, as depicted in FIG. 4, the racks can be used to retain containers with some variation in diameter. For transporting containers 12 significantly larger than those diagrammatically depicted in FIG. 4, the rack preferably should have retention posts 35 spaced greater distances than illustrated, and for transporting containers significantly smaller than those depicted in FIG. 4, the spacing between the retention posts 35 should be less. Since the cylindrical containers commonly are color-coded with respect to size, the racks 11 preferably may be designed for the specific container sizes and may be similarly color-coded to facilitate selection and use with the appropriately sized and similarly colored containers.

Figure 10:
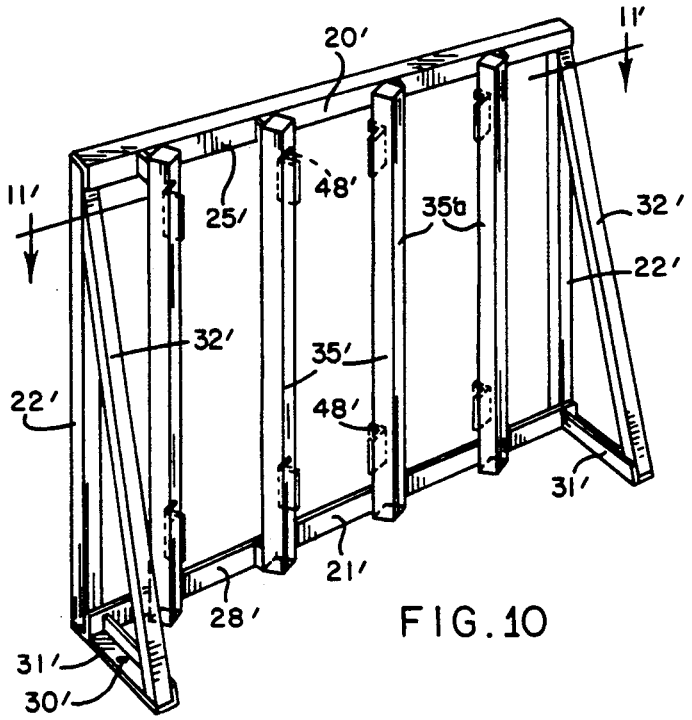
FIG. 10 is a perspective of an alternative embodiment of gas cylinder retention device.
Figure 11:
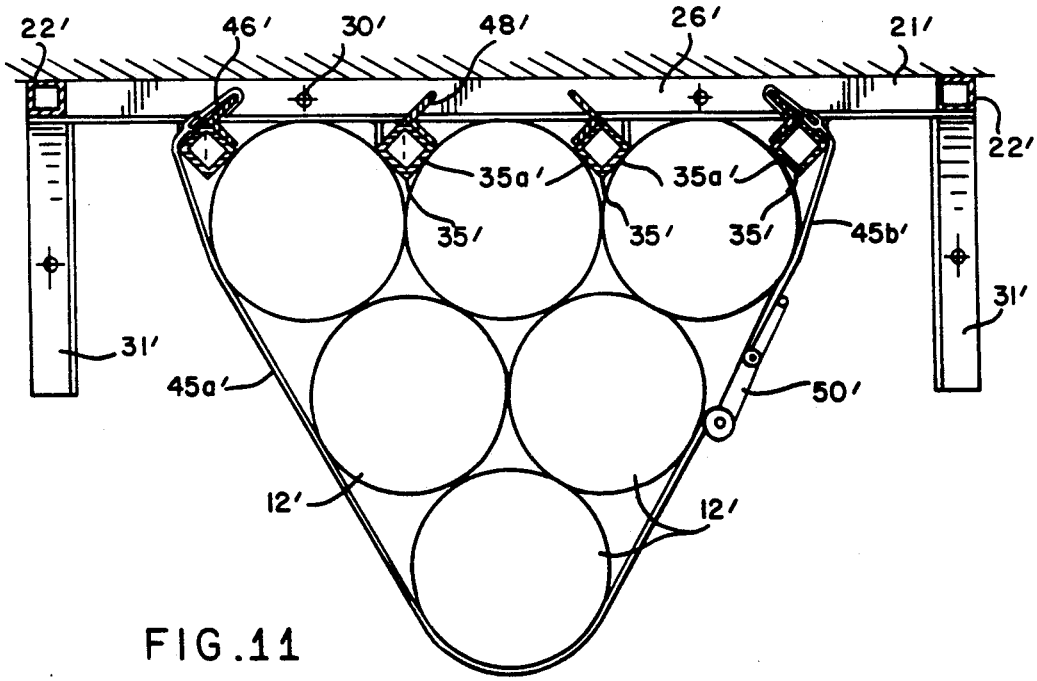
FIG. 11 is a horizontal section illustrating the retention of a plurality of gas cylinders in the retention device shown in FIG. 10.

Referring now more particularly to FIGS. 10 and 11 of the drawings, there is shown an alternative embodiment of retention rack 11' wherein items similar to those described above have been given similar reference numerals with the distinguishing suffix "'". The rack 11', which is particularly adapted for mounting adjacent a single side or end wall 15, 16 of the truck trailer, includes straight opposite ends by upstanding frame members 22'. A longitudinal array of laterally spaced cylinder retention posts 35', substantially identical to those described previously, are affixed to the support rails 20', 21' in a common plane. To provide stability for the rack 11', legs 31' are provided in forwardly extending relation from opposite ends of the bottom support rail 21', which each are rigidified by a cross brace 32' As illustrated in FIG. 11, any of a plurality of cylindrical containers 12' may be positioned between respective retention posts 35' with further containers being stacked outwardly therefrom, and such array may be retained by retaining straps 45*a'*, 45*b'* secured in encompassing relation about the containers between tension posts on opposite sides of the containers.

From the foregoing, it can be seen that the racks of the present invention are adapted for reliably and safely retaining relatively heavy gas cylinders in upright condition during transport in a truck trailer or the like. The racks are adapted to accommodate a single container, or a plurality of containers, in a free standing mode for safe transport and for easy access during loading and unloading. Since the racks are of a modular, relatively simple design, they lend themselves to easy installation and removal within a truck trailer for the purpose of accommodating different sizes and numbers of cylindrical containers for transport.

What is claimed is:

1. A retention device for retaining cylindrical containers in upright, nested condition within a storage area comprising:

frame means including a first base member;

a plurality of vertically extending, parallel container retention posts connected to said base member at spaced intervals therealong; and releasable strap means for encompassing the positioned and nested containers and for retaining the containers firmly against said retention posts and against each other;

wherein each post includes a pair of continuous support surfaces which converge within said storage area such that support surfaces of adjacent posts diverge within said storage area, and wherein each support surface of said pair of support surfaces supports a container sidewall in bearing engagement;

whereby a plurality of said containers may be positioned in side-by-side relationship with each container being disposed in bearing engagement against support surfaces of a respective pair of posts.

2. The retention device of claim 1 in which said frame means include legs disposed in forwardly extending relation at opposite ends of said base members for stabilizing upright mounting of the device.

3. The retention device of claim 1 in which said strap means includes hooks at opposite ends thereof for releasable engagement with said retention posts and means for tightening of said strap means about the containers to be retained against said retention posts.

4. The retention device of claim 3 in which said retention posts each include outwardly extending mounting means upon which said strap means hooks are engageable.

5. The retention device of claim 4 in which said outwardly extending hook engageable mounting means of said retention posts include plates mounted in rearwardly extending relation to the retention posts.

6. The retention device of claim 1 in which said retention posts have a substantially square tubular construction and are supported by said frame means such that adjacent retention posts define a pair of bearing and support surfaces which extend inwardly from said frame means and are disposed at an angle to each other against which one of said cylindrical containers are in bearing engagement at circumferentially spaced points about the perimeter of the container.

7. The retention device of claim 6 in which adjacent retention posts support each of said containers at points of engagement circumferentially spaced about the perimeter of the container at an angle of about 95°.

8. The retention device of claim 7 in which said first base member and first upper frame member each are angle irons, said base member having a horizontal flange for mounting on a floor and an upstanding flange against which said retention posts are secured.

9. The retention device of claim 8 in which said horizontal flange of said base member is formed with mounting apertures.

10. The retention device of claim 1, wherein said frame means further comprises a second base member connected at one end to said first base member to form an L-shaped configuration therewith and wherein additional retention posts are connected to said second base member at spaced intervals therealong.

11. The retention device of claim 1 in which each said retention post is connected at a lower end to said first base member.

12. The retention device of claim 1, wherein said frame means further comprises:

a first upper frame member parallel to said first base member, each retention post being connected at an upper end to said first upper frame member at spaced intervals therealong.

13. The retention device of claim 12, wherein said frame means further comprises:

a second upper frame member perpendicular to said first upper frame member and connected at one end thereto;

a second base member parallel to said second upper frame member and connected at one end to said first base member; and additional vertically extending retention posts, each of said additional retention posts connected at a lower end to said second base member and at an upper end to said second upper frame member;

whereby said retention device has an L-shaped configuration.

14. The retention device of claim 13, wherein said strap means includes hooks at opposite ends thereof for releasable engagement with said retention posts and means for tightening said strap means about containers to be retained against said retention posts and wherein said retention posts each include mounting means extending outwardly from said storage compartment for releasably securing said hooks, said mounting means including plates each mounted on respective retention posts and lying in a plane which is parallel to a plane bisecting the angle defined by the connection between the base members.

15. In a truck trailer having a flat bed, side and end walls, and a top for defining an interior cargo containing area, at least one gas cylinder container retention device within said cargo containing area comprising frame means including a first base member, means for securing said frame means to said flat bed, a plurality of vertically extending, parallel container retention posts connected to said base member at spaced intervals therealong; and releasable strap means for encompassing the positioned and nested containers and for retaining the containers firmly against said retention posts and against each other;

wherein each post includes a pair of continuous support surfaces which converge within said storage area such that support surfaces of adjacent posts diverge within said storage area, and wherein each support surface of said pair of support surfaces supports a container sidewall in bearing engagement;

whereby a plurality of said containers may be positioned in side-by-side relationship with each container being disposed in bearing engagement against support surfaces of a respective pair of posts.

16. In a truck trailer of claim 15, wherein said frame means further comprises a second base member connected at one end to said first base member to form an L-shaped configuration therewith, and wherein additional retention posts are connected to said second base member at spaced intervals therealong, and wherein said retention device is mounted on said flat bed with said first base member adjacent a side wall of said trailer and said second base member adjacent an end wall of said trailer.

17. In a truck trailer of claim 15, wherein said frame means further comprises:

a first upper frame member parallel to said first base member, each retention post being connected at an upper end to said first upper frame member at spaced intervals therealong, and wherein said retention device is mounted on said flat bed with said base member adjacent a side wall of said trailer.

18. In a truck trailer of claim 17, wherein said frame means further comprises:

a second upper frame member perpendicular to said first upper frame member and connected at one end thereto;

a second base member parallel to said second upper frame member and connected at one end to said first base member; and additional vertically extending retention posts, each of said additional retention posts connected at a lower end to said second base member and at an upper end to said second upper frame member;

whereby said retention device has an L-shaped configuration and is mounted on said flat bed with said first base member adjacent a side wall of said trailer and said second base member adjacent and end wall of said trailer.

19. In a truck trailer of claim 15 in which said strap means includes hooks at opposite ends thereof for releasable engagement with said retention posts and means for tightening of said strap means about the containers to be retained against said retention posts.

20. In a truck trailer of claim 19 in which said retention posts each include outwardly extending mounting means upon which said strap means hooks are engageable.

21. In a truck trailer of claim 15 in which said retention posts have a substantially square tubular construction and are supported by said frame means such that adjacent retention posts define a pair of bearing and support surfaces which extend inwardly from said frame means and are disposed at an angle to each other against which one of said cylindrical containers are in bearing engagement at circumferentially spaced points about the perimeter of the container.

* * * * *